United States Patent [19]

Skinner

[11] 3,930,484

[45] Jan. 6, 1976

[54] LIQUID FUEL PUMPING APPARATUS

[75] Inventor: Robert Thomas John Skinner, High Wycombe, England

[73] Assignee: C.A.V. Limited, Birmingham, England

[22] Filed: July 22, 1974

[21] Appl. No.: 490,899

[30] Foreign Application Priority Data

July 28, 1973 United Kingdom ..... 36055/73

[52] U.S. Cl. ..... 123/139 AM; 123/139 AN

[51] Int. Cl.[2] ..... F02M 39/00

[58] Field of Search.. 123/139 AM, 139 R, 139 AY, 123/139 AN, 139 AJ, 139 BC, 139 AB, 139 AC, 139 AK

[56] References Cited

UNITED STATES PATENTS

| | | | |
|---|---|---|---|
| 2,898,900 | 8/1959 | Ribaux | 123/139 AM |
| 3,516,395 | 6/1970 | Bassot | 123/139 AM |
| 3,615,043 | 10/1971 | Hussey | 123/139 AM |
| 3,789,818 | 2/1974 | Asbery | 123/139 AM |
| 3,818,882 | 6/1974 | Leonov | 123/139 AN |

*Primary Examiner*—Charles J. Myhre
*Assistant Examiner*—Daniel J. O'Connor
*Attorney, Agent, or Firm*—Andrus, Sceales, Starke & Sawall

[57] ABSTRACT

A fuel injection pumping apparatus includes an injection pump to which fuel is supplied by means of an axially movable shuttle which is contained within a cylinder. Fuel is supplied to one end of the cylinder through a metering valve from a first source of fuel under pressure. The fuel contained in said one end of the cylinder is displaced to the injection pump by applying fuel under pressure to the other end of the cylinder containing the shuttle from a further source of fuel under pressure. The pressure of the further source of fuel is higher than that of the first mentioned source.

15 Claims, 4 Drawing Figures

LIQUID FUEL PUMPING APPARATUS

This invention relates to liquid fuel injection pumping apparatus for supplying fuel to internal combustion engines, and of the kind comprising an injection pump driven in timed relationship with an associated engine, a bore, a shuttle slidable in the bore, first valve means through which one end of the bore can be placed in communication with the injection pump during the filling strokes thereof, and whereby at other times it can be placed in communication with the source of fuel under pressure, an adjustable throttle member for determining the amount of fuel which can flow to said one end of the bore, thereby to vary the amount of fuel which is displaced to the injection pump during a filling stroke thereof, and means for effecting movement of the shuttle towards said one end of the bore thereby to displace fuel to the injection pump.

The object of the invention is to provide such an apparatus in a simple and conveninet form.

According to the invention, said means comprises a second valve means operable to place the other end of the bore in communication with a further source of fuel under pressure to effect movement of the shuttle towards said one end of the bore during the filling periods of the injection pump, and with a drain to permit the shuttle to move away from said one end of the bore, the pressure of the further source being higher than that of the first mentioned source.

According to a further feature of the invention, the apparatus includes a fluid pressure operable means for effecting adjustment of a component of the injection pump, the pressure applied to said fluid pressure operable means being obtained by means of a fluid potentiometer, including a pair of restrictors, one of said restrictors having a size which is varied in accordance with the setting of said throttle member.

Figure 1:
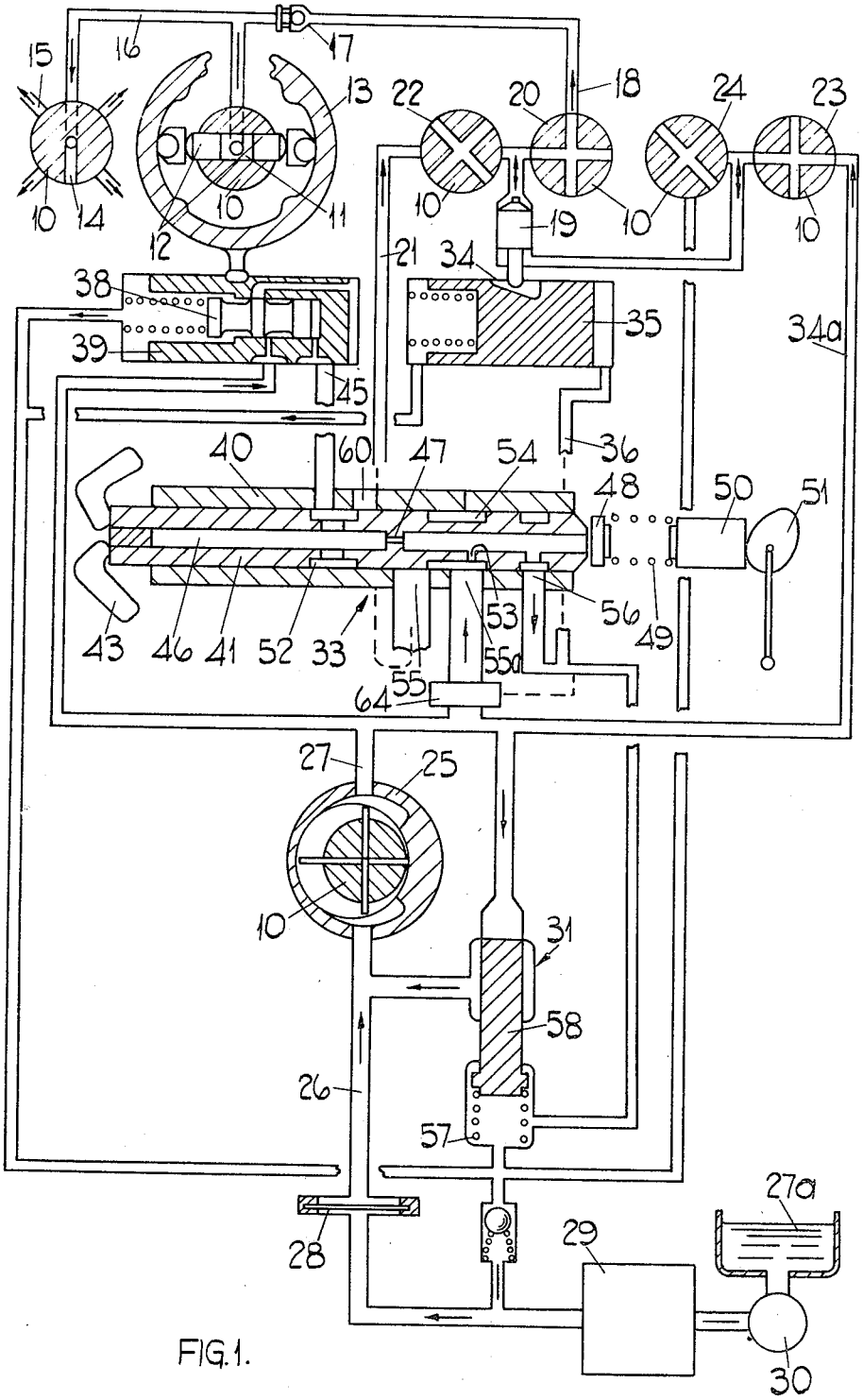
Figure 2:
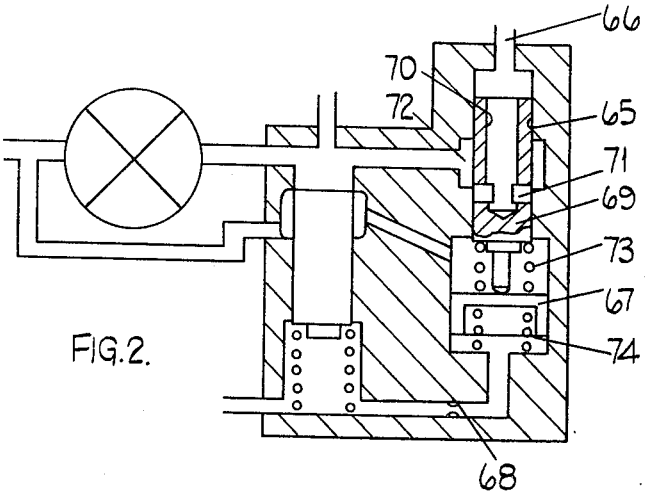
Figure 3:
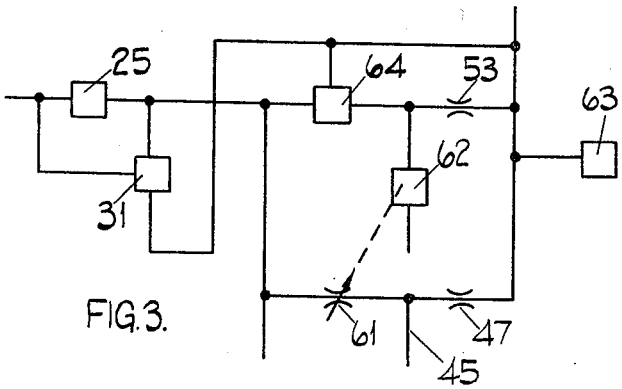
Figure 4:
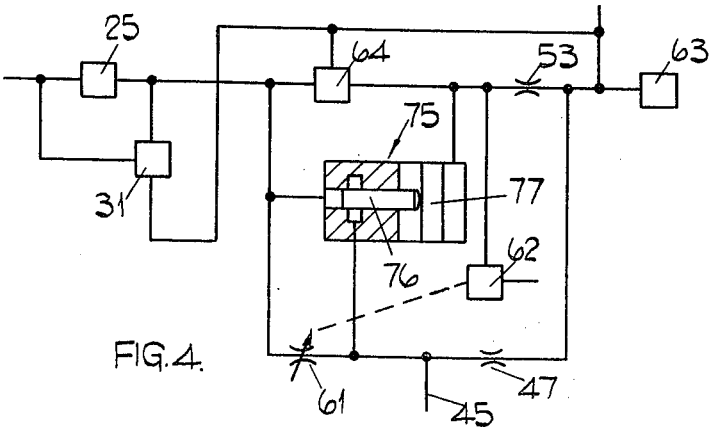

Examples of fuel pumping apparatus in accordance with the invention will now be described with reference to the accompanying drawings in which:

FIG. 1 is a diagramatic representation of one example of an apparatus in accordance with the invention, FIG. 2 shows how two of the components shown in FIG. 1 can be combined into a single body, FIG. 3 shows a fluid circuit diagram of a portion of the apparatus seen in FIG. 1, and FIG. 4 shows an alternative fluid circuit diagram.

Referring to FIG. 1 of the drawings, the apparatus comprises a body part in which is journalled a rotary cylindrical distributor member 10 which is shown divided into seven parts. The distributor member is adapted to be driven in timed relationship with the engine with which the apparatus is associated. At one point, in the distributor member there is formed a transversely extending bore 11 in which is mounted a pair of reciprocable pumping plungers 12. Surrounding the distributor member at this point is an annular cam ring 13 having on its internal periphery, a plurality of pairs of diametrically disposed cam lobes. The cam lobes through the intermediary of rollers respectively, act upon rotation of the distributor member, to move the pumping plungers 12 inwardly thereby to expel fuel contained within the transverse bore 11. The pumping plungers 12, together with the cam lobes constitute an injection pump.

The transverse bore 11 communicates with a passage 16 extending within the distributor member, and at one point this passage communicates with an outwardly extending delivery passage 14 which is adapted to register in turn, and as the distributor member rotates, with a plurality of outlet ports 15 formed in the body part. The outlet ports in use, are connected to the injection nozzles respectively of the associated engine.

The passage 16 is in communication by way of a check valve 17 with a passage 18, and this passage can be brought into communication with one end of a bore containing a slidable shuttle 19, by means of a rotary valve 20. The aforesaid one end of the bore at other times, as will be explained, can be placed in communication with a feed passage 21 by means of a rotary valve 22, the valves 20 and 22 constitute a first valve means.

The other end of the bore containing the shuttle can be placed in communication with a source of fuel at a high pressure by means of a rotary valve 23 or with a source of fuel at low pressure by means of a rotary valve 24, the valves 23 and 24 constituting a second valve means. The valves 20, 22, 23 and 24 are formed in or on the distributor member 10 and are driven in timed relationship with the engine. In addition, also mounted on the distributor member is a feed pump 25 of the rotary vane type and having an inlet 26 and an outlet 27. The inlet 26 is in communication with a supply of fuel **27*a* by way of a pair of filter units 28, 29 and a lift pump 30 is provided to ensure the supply of fuel to the feed pump. The output pressure of the feed pump 25 is controlled by a relief valve 31, the function of which will be described later in the specification. The outlet 27 of the feed pump communicates by way of a passage 34*a* with the valve 23** the purpose of which has already been explained.

The operation of the apparatus thus far described is as follows. With the parts of the apparatus in the position shown in FIG. 1, fuel is flowing from the outlet of the feed pump by way of the valve 23 to said other end of the bore containing the shuttle 19 and the shuttle is being moved towards said one end of the bore. Fuel is therefore displaced from this end of the bore, and flows by way of the rotary valve 20 and the check valve 17 to the passage 16 and particularly to the bore 11. The plungers 12 are therefore moved outwardly by an amount dependent upon the quantity of fuel displaced by the shuttle 19.

During continued rotation of the distributor member, the passage 14 is brought into register with an outlet port 15, and during this time the plungers 12 are moved inwardly, and fuel is displaced from the bore 11 to the appropriate engine cylinder. Also during this time, the rotary valves 20 and 23 are closed and valves 22 and 24 are open so that fuel now flows to said one end of the bore containing the shuttle 19, and the shuttle is therefore moved towards the other end of the bore. The quantity of fuel which is supplied to the bore containing the shuttle is controlled by a metering valve 33, which will be described later and this therefore determines the quantity of fuel which is supplied to the injection pump during a filling stroke, and thereby, the amount of fuel which is supplied to the associated engine at each injection stroke. During continued rotation of the distributor member, the process described is repeated, and fuel is supplied to the engine cylinders in turn.

It will be appreciated that the shuttle 19 determines the maximum quantity of fuel which can be supplied by the apparatus at each injection stroke. The maximum quantity of fuel which is supplied to an engine is varied in accordance with the speed of the engine to provide shaping of the maximum fuel characteristic so that the maximum excursion of the shuttle must be made to vary in accordance with the speed of the engine. For this purpose, the shuttle 19 is provided with an extended end portion which can co-operate with a cam surface 34 formed on a spring loaded piston 35. The piston is movable against the action of its spring, by means of fuel supplied under pressure to one end of the cylinder by way of a passage 36. The pressure of the fuel which is supplied to the passage is dependent upon the speed at which the apparatus is driven, and the way in which it is derived will be explained later. The effect is that the axial setting of the piston 35 will be dependent upon the speed of the associated engine, and thereby the allowed excursion of the shuttle 19 will also be dependent upon the engine speed.

There is also provided a fluid pressure operable member in the form of a servo-piston 39, and this is connected to the cam ring 13 by means of a peg. The piston 39 is provided with a bore in which is mounted a spring loaded servo-valve 38. The servo-valve controls the admission or escape of fuel under pressure to and from one end of the cylinder containing the piston 39. The fuel under pressure supplied to the cylinder is derived from the outlet 27 of the feed pump, and the servo-valve 38 is subjected to a pressure existing in a branch conduit 45. As this pressure increases, the servo-valve 38 will be moved against the action of its spring towards the left as seen in FIG. 1, and the servo-piston 37 will follow this movement, thereby moving the cam ring 13 angularly and altering the timing of injection of fuel to the engine.

Considering now the metering valve 33. This comprises a sleeve 40 which is fixed within the body of the apparatus. Within the sleeve there is mounted an axially slidable rod member 41, which at one end is provided with a head against which bear the toe portions of as illustrated, a pair of governor weights 43. The weights are mounted within a cage not shown, and the latter is driven by gearing from the distributor member 10 so that the speed of rotation of the weights is directly proportional to the speed at which the engine is driven. Extending axially within the rod member is a bore 46 which at its end adjacent the weights is closed by a plug. Moreover, intermediate its ends, the bore is provided with a restrictor 47. At its opposite end, the bore 46 is obturated by a valve member 48, the latter being loaded by means of a coiled compression spring 49. The opposite end of the coiled compression spring is engaged by a movable abutment 50, the axial position of which and thereby the force exerted by the spring 49, can be adjusted by means of a cam 51 connected to an operator adjustable member. The portion of the bore 46 which is closed by the plug, is in constant communication with the branch conduit, 45, this being achieved by a circumferential groove 52 on the rod member which is constant communication with a port in the sleeve member 40, and communicating with the branch conduit 45. The other end of the passage 46 is in communication by way of a restrictor 53, with a further circumferential groove 54 formed on the rod member. Moreover, formed in the sleeve is a port 55 which is in communication with the passage 21. The port 55 is positioned so that the groove 54 can have partial registration therewith for the purpose to be explained. Furthermore, the circumferential groove 54 is in constant communication with the outlet 27 of the feed pump by way of a further port **55*a* formed in the sleeve and a device 64** the purpose of which will be explained.

The right hand portion of the bore 46 is in constant and unrestricted communication by way of a further circumferential groove and a port 56, with the passage 36 which communicates with one end of the cylinder containing the piston 35. In addition, the port 56 is in constant and unrestricted communication with the chamber which contains the spring 57 which loads the valve member 58 of the relief valve. The spring 57 urges the valve member 58 towards the closed position in which no fuel is spilled from the outlet of the feed pump. Finally there is formed in the sleeve, a port 60. The port 60 is in constant communication with the outlet 27 of the feed pump and the port 60 can register to a varying amount depending upon the axial position of the rod member 41, with the circumferential groove 52. The port 60 and circumferential groove 52 constitute the variable restrictor 61 seen in FIG. 3. Also seen in FIG. 3 is the throttle valve 62, the latter being constituted by the port 55 and the circumferential groove 54, and also shown in FIG. 3 is a block 63 which represents the rod member 41, the weights 43 and the valve member 48.

In operation, the axial setting of the rod 41 is dependent upon the speed at which the engine is driven, and as the engine speed increases, the weights 43 will be moved outwardly thereby imparting as shown in FIG. 1, movement towards the right against the action of the spring 49. As explained, the force exerted by the spring 49 can be varied, and if the spring force is increased, then for a given engine speed, the rod member will move towards the left against the action of the weights. The fuel pressure existing in the right hand end of the bore 46 is by virtue of the restrictor 53 and the valve member 48 proportional to the square of the speed at which the engine is driven. In fact the valve member 48 will be lifted slightly from the end of the passage 46 so that flow of fuel will occur through the restrictor 53. If for any reason there is a tendency for the pressure to increase at a given speed, then the valve member will lift further to allow an increased flow of fuel.

The pressure in the right hand end of the passage 46 is allowed to act upon the valve member 58 of the relief valve 31 and in so doing it enhances the force exerted by the spring 57. The outlet pressure of the feed pump therefore will have a value which is higher than the pressure existing in the right hand end of the passage 46 by an amount dependent upon the spring force. In other words the pressure is dependent upon the square of the engine speed plus a constant determined by the spring force.

The axial position of the rod member 41 determines the amount of fuel which flows to the injection pump during the filling strokes thereof. This of course is controlled by the throttle valve 62, which as previously stated, is represented by the port 55 and the circumferential groove 54. As the engine speed decreases for a given setting of the abutment 50, the groove 54 will move further into register with the port 55 thereby allowing an increased flow of fuel to the engine. Conversely if the engine speed should increase, the amount of fuel flowing will be reduced. It will be seen therefore that a governor action is obtained. If the abutment 50 is moved by the operator, then movement of the rod 41 will occur until a new equilibrium position is established, and if for example the abutment 50 is moved towards the left, more fuel will be supplied to the engine so that the engine speed will increase. Conversely, if the abutment is moved towards the right, the amount of fuel supplied to the engine will decrease and therefore the engine speed will decrease.

The device 64 is a pressure regulating valve one construction of which will be described. The duty of the device or valve is to act as a source of fuel under pressure for supply through the throttle valve, to the bore containing the shuttle. It should be noted however that the fuel from the device 64 only flows to said one end of the bore, the other end of the bore being supplied with fuel from the outlet of the feed pump. The device 64 also acts as a source of fuel by way of the restrictor 53 for the device 63.

The pressure of fuel supplied by the device 64 is lower than that existing at the outlet of the feed pump and the pressure/speed characteristic is tailored so that for a constant load on the engine the setting of the metering valve or in other words the axial position of the rod 41 varies little with variation in engine speed. In this way the axial setting of the rod 41 provides a true indication of the load on the engine. The device 64 therefore is designed to provide a pressure which varies in accordance with a constant multiplied by the square of the speed.

The pressure which is applied through the branch conduit 45 will also be dependent upon the setting of the rod member 41. As the rod moves towards the left, then the size of the restrictor 61 will be reduced so that the pressure supplied by way of the branch conduit will more nearly approach the pressure existing in the right hand end of the passage 46, that is to say it will approach the pressure which is proportional to the square of the speed. Conversely, as the rod member is moved towards the right, the size of the restrictor 61 will be increased and the pressure will more nearly approach the outlet pressure of the feed pump. In other words whilst the pressure supplied through the branch conduit is dependent upon the speed at which the engine is driven. It is also dependent upon the axial setting of the rod 41 which is representative of the load on the engine.

With reference now to FIG. 2 there is illustrated a practical arrangement of the valve 31 and device 64. The valve 31 is as shown in FIG. 1 but formed in the same body as the valve 31 is a bore 65 which at one end communicates with a passage 66 communicating with the port 55*a*. At the other end the bore 65 is englarged and accommodates a piston 67 which is urged towards the narrower end of the bore by pressure derived by way of a damping restrictor 68, from the right hand end of the bore 46 in the rod 41. The portion of the bore lying between the step therein and the piston 67 communicates with the inlet of the feed pump.

Slidable within the narrower portion of the bore 65 is a valve element 69. The element 69 has an extension bearing upon the piston 67 and a central drilling 70 extending from the end of element at said one end of the bore. The drilling terminates in opposed ports 71 on the periphery of the element and these are positioned below a circumferential groove 72 formed in the wall of the bore 65. The groove communicates with the outlet of the feed pump and in use, the valve element moves to control the pressure of fuel supplied to the passage 66 in a manner depending upon the ratio of the areas of the piston 67 and valve element and the square of the speed at which the engine is driven. In the particular example the area ratio is 1.7.

A spring 73 may be provided intermediate the piston 67 and valve element 69 and this will provide a minimum value of pressure at low engine speeds. Furthermore, a spring 74 may be provided to act on the piston, the effect of the spring being to introduce a constant spring force component into the pressure characteristic.

In the example described, restrictor 53 is permanently in the fluid circuit with restrictors 61 and 47 connected in series and effectively in parallel with restrictor 53. It is possible to eliminate the restrictor 53, and the connection through it between the outlet of the feed pump and the device 63. In this case, the restrictors 61 and 47 provide the flow of fuel necessary so that the device 63 can regulate the pressure, but it will be appreciated that in no circumstances can the restrictor 61 be closed, otherwise there would be no flow of fuel for control by the device 63.

In the example described the fluid potentiometer defined by the restrictors 47 and 61 is disposed intermediate the outlet of the feed pump and the device 63. The lowest level of pressure which can be applied to the servo-piston is therefore the pressure which is dependent upon the square of the speed in other words the pressure determined by the device 63. In some instances it is desirable that the pressure should be that which is determined by the device 64. This is achieved by connecting the conduit containing the restrictor 47 to a point intermediate the device 64 and the restrictor 53.

Moreover, in the arrangements described above the restrictor 53 is connected to the outlet of the feed pump by way of the device 64. This is not essential and the conduit containing the restrictor 53 may be connected directly to the outlet 27 of the feed pump.

The arrangement shown in FIG. 4 is a modification of the arrangement shown in FIG. 3 and includes a switch valve 75. This valve controls a by-pass passage which when open, by-passes the restrictor 61. The valve 75 includes a valve element 76 urged towards an open position by fuel under pressure from the outlet of the feed pump and urged in the opposite direction by a piston 77 which is subjected to the pressure determined by the device 64. The area of the piston 77 is greater than that of the valve element and at low engine speeds the valve is open so that the pressure of fuel supplied to the conduit 45 is the outlet pressure of the feed pump irrespective of the load. As the engine speed increases, the valve will close and the pressure of fuel supplied to the conduit will again be controlled by the potentiometer comprising restrictions 47 and 61. The switch valve operates owing to the fact that the curves of the output pressure of the feed pump and the pressure determined by the device 64 converge with increasing speeds.

In an alternative arrangement the piston 77 is omitted and the valve element is biased by a spring. The porting arrangement is also altered so that as in the previous example the valve closes when a predetermined speed is attained. In the case, however, the closure is progressive.

I claim:

1. A liquid fuel injection pumping apparatus for supplying fuel to internal combustion engines, and of the kind comprising an injection pump driven in timed relationship with an associated engine, a bore, a shuttle slidable in the bore, first valve means through which one end of the bore can be placed in communication with the injection pump during the filling strokes thereof, and means whereby at other times it can be placed in communication with a source of fuel under pressure, an adjustable throttle member for determining the amount of fuel which can flow to said one end of the bore, thereby to vary the amount of fuel which is displaced to the injection pump during a filling stroke thereof, means for effecting movement of the shuttle towards said one end of the bore thereby to displace fuel to the injection pump, said means comprising a second valve means operable to place the other end of the bore in communication with a further source of fuel under pressure to effect movement of the shuttle towards said one end of the bore during the filling periods of the injection pump, and with a drain to permit the shuttle to move away from said one end of the bore, the pressure of the further source being higher than that of the first mentioned source.

2. An apparatus as claimed in claim 1 including a feed pump for delivering fuel under pressure, third valve means operable to derive from the outlet pressure of the feed pump a pressure which varies in accordance with the square of the speed at which the apparatus is driven.

3. An apparatus as claimed in claim 2 in which said further source of fuel is the feed pump, said first mentioned source of fuel comprising a fourth valve means connected between the outlet of the feed pump and said throttle member, said fourth valve means being constructed so as to provide at the upstream side of the throttle member a pressure substantially proportional to $RN^2$.

4. An apparatus as claimed in claim 3 in which said fourth valve means includes a valve element movable to vary the flow of fuel between an inlet and an outlet of the valve means, the outlet of the valve means being connected to the upstream side of the throttle member, said valve element being subject to the pressure of fuel in the outlet, said pressure acting to move the valve element to restrict the flow of fuel through the valve means, the valve element being urged in the opposite direction by a piston subject to the pressure which varies as the square of the speed at which the apparatus is driven, the area of the piston being larger than that of the valve element, the ratio of the areas being the constant R.

5. An apparatus as claimed in claim 4 including a spring interposed between the piston and the valve element.

6. An apparatus as claimed in claim 4 including a spring acting on the piston.

7. An apparatus as claimed in claim 3 in which said third valve means communicates with the outlet of the feed pump through a first restrictor.

8. An apparatus as claimed in claim 7 including a fluid pressure operable means for effecting adjustment of a component of the injection pump, the pressure applied to said fluid pressure operable means being obtained by means of a fluid potentiometer including a pair of restrictors one of said restrictors having a size which is varied in accordance with the setting of said throttle member.

9. An apparatus as claimed in claim 8 in which said one of said pair of restrictors communicates with the outlet of the feed pump the other of said pair of restrictors being defined by said first restrictor.

10. An apparatus as claimed in claim 8 in which said pair of restrictors are connected in series in said potentiometer chain, one end of said chain being subject to the outlet pressure of the feed pump and the other end of the chain being subject to the pressure which varies as the square of the speed, a point intermediate said pair of restrictors being connected to said fluid pressure operable means.

11. An apparatus as claimed in claim 10 in which the restrictor of said pair of restrictors intermediate said point and the outlet of the feed pump is the restrictor which is adjustable.

12. An apparatus as claimed in claim 7 in which said first restrictor communicates directly with the outlet of the feed pump.

13. An apparatus as claimed in claim 7 in which said first restrictor communicates with the outlet of the feed pump through said fourth valve means.

14. An apparatus as claimed in claim 11 including a by-pass passage for the adjustable one of said pair of restrictors and a switch valve in said by-pass passage, said switch valve including a valve element subject to the outlet pressure of the feed pump and operable with increasing speed of operation of the apparatus to close said by-pass passage.

15. An apparatus as claimed in claim 14 including a piston subjected to the pressure of fuel delivered by said first mentioned source, said piston acting against the valve element in opposition to the force exerted on the valve element by the outlet pressure of the feed pump.

* * * * *